US006616727B1

(12) United States Patent
Koyama et al.

(10) Patent No.: US 6,616,727 B1
(45) Date of Patent: Sep. 9, 2003

(54) POROUS METAL POWDER

(75) Inventors: Tadashi Koyama, Kyoto (JP); Yoshiro Arami, Shiga (JP); Masato Kikukawa, Shiga (JP); Osamu Iwatsu, Kobe (JP); Yasuhiko Hashimoto, Himeji (JP)

(73) Assignee: Fukuda Metal Foil & Powder Co., Ltd., Kyoto (JP)

( * ) Notice: Subject to any disclaimer, the term of this patent is extended or adjusted under 35 U.S.C. 154(b) by 0 days.

(21) Appl. No.: 09/706,428

(22) Filed: Nov. 3, 2000

Related U.S. Application Data

(63) Continuation of application No. PCT/JP00/01169, filed on Feb. 29, 2000.

(30) Foreign Application Priority Data

Mar. 3, 1999 (JP) ..... 11-055003

(51) Int. Cl.[7] ..... B22F 9/04
(52) U.S. Cl. ..... 75/255; 75/253; 420/469
(58) Field of Search ..... 75/253, 255; 148/432; 420/469

(56) References Cited

U.S. PATENT DOCUMENTS

| | | | | |
|---|---|---|---|---|
| 3,492,113 A | | 1/1970 | Shafer et al. | |
| 3,888,657 A | | 6/1975 | Klar et al. | |
| 4,432,813 A | * | 2/1984 | Williams | 148/514 |
| 4,776,885 A | * | 10/1988 | Nakagawa et al. | 75/229 |
| 5,594,186 A | * | 1/1997 | Krause et al. | 75/228 |
| 6,036,839 A | * | 3/2000 | Kohut et al. | 205/574 |
| 6,322,609 B1 | * | 11/2001 | Kohut et al. | 75/255 |

FOREIGN PATENT DOCUMENTS

| | | | |
|---|---|---|---|
| JP | 52-37475 | | 9/1977 |
| JP | 63-243210 | | 10/1988 |
| JP | 1-162701 | | 6/1989 |
| JP | 01-162701 | * | 6/1989 |
| JP | 2-11702 | | 1/1990 |
| JP | 02-011702 | * | 1/1990 |

* cited by examiner

*Primary Examiner*—George Wyszomierski
(74) *Attorney, Agent, or Firm*—Akin Gump Strauss Hauer & Feld, L.L.P.

(57) ABSTRACT

The present invention relates to a method of preparing porous metal powder, a starting metal being oxidized and then reduced followed by that the obtained block metal body is milled. According to the present invention, the starting metal is oxidized in the presence of chlorine and/or chloride. The present block metal body after reduction has prismatic particles complicatedly entangled like a root so that the pore of the metal powder is open.

4 Claims, 5 Drawing Sheets

In case of adding chlorine

In the absence of chlorine

*(a)*

*(c)*

*(b)*

*(d)*

POROUS METAL POWDER

CROSS-REFERENCE TO RELATED APPLICATION

This application is a continuation of International Application No. PCT/JP00/01169 filed Feb. 29, 2000 the disclosure of which is incorporated herein by reference.

BACKGROUND OF THE INVENTION

1. Technical Field

The present invention relates to metal powder having open and homogenous pores.

2. Background Arts

Porous metal powder is sintered into various metal products such as a catalyst, an electrode, a filter and an oil impregnated sintered bearing. The metal powder useful for such applications has many pores, the pores being very important for the metal products to function. Recently, it is required to raise the performance of the metal products, for which porous metal powder qualified better is demanded. For example, it is required to develop porous metal powder modified to have homogenous and open pores.

There have been various methods for preparing porous metal powder. One way is disclosed in the U.S. Pat. No. 3,888,657 to heat starting metal to form pores. Also, another way is disclosed in the Japanese patent No.52-37,475 to oxidize and then reduce starting metal to form pores. The latter way, commonly referred to as an oxidation-reduction method, is remarked as a method for preparing metal powder having many fine pores.

BRIEF SUMMARY OF THE INVENTION

Present invention provides a novel oxidation-reduction method improved for preparing metal powder having fine and homogenous open pores.

Solution

There is provided a method for preparing porous metal powder in which a starting metal is oxidized and then reduced followed by that thereby obtained block metal body is milled. According to the present invention, the starting metal is oxidized in the presence of chlorine and/or chloride.

The reduced block metal body according to the present invention comprises prismatic particles entangled like a root so that the pore formed in the metal powder is open.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

[Starting Metal]

Figure 1:
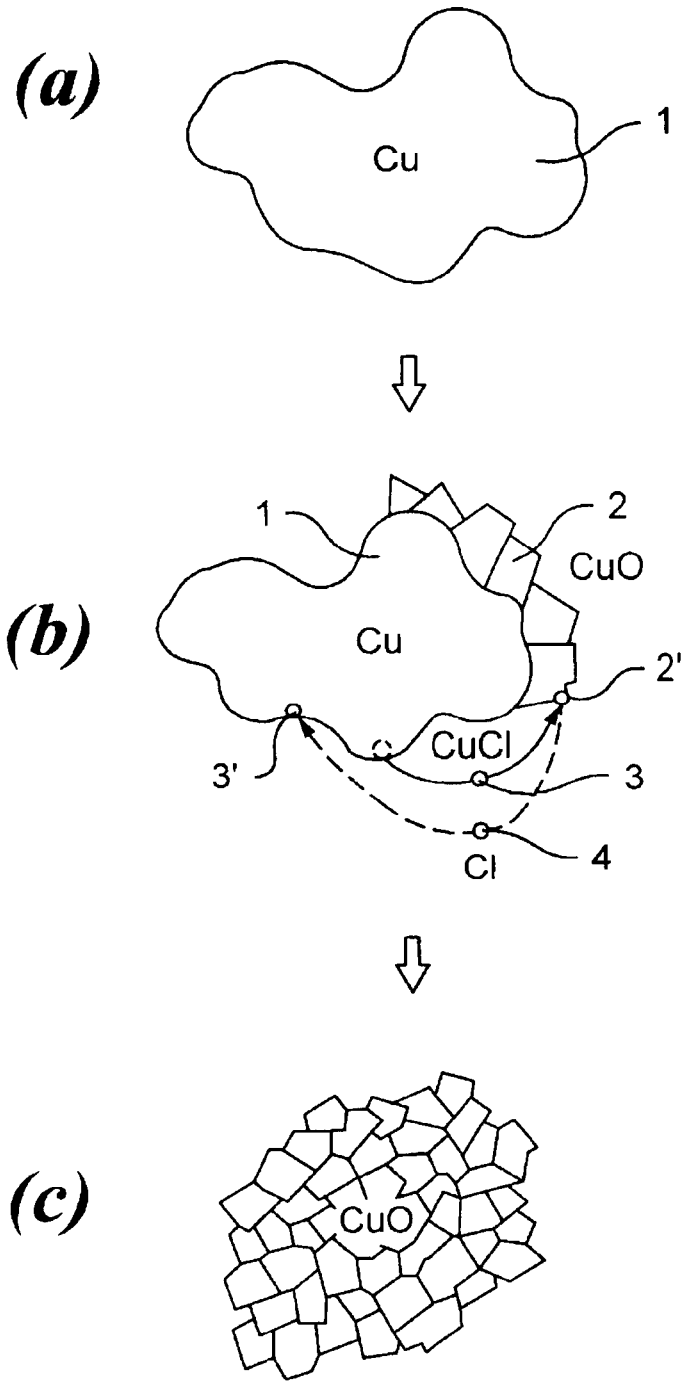
FIG. 1 schematically shows several steps of metal oxide growing in the oxidation reaction according to the present invention.

According to the present oxidation-reduction method, various metals may be used as a starting material, as, long as it may be oxidized in the presence of chlorine or. chloride and then reduced. Therefore, the starting metal is not limited, but favorable starting metal useful for the present invention may include metal elements of IIA~VIIA, IIIV and IB~VIB in the elemental periodic table, and their alloys. In particularly, it is useful for the present invention to use a starting metal of an element selected from the group consisting of cobalt, iron, nickel, copper, zinc and tin, and its alloy. Further, the preferable starting metal according to the present invention is copper or copper alloy. The copper alloy may preferably be copper-tin alloy, copper-zinc alloy and copper nickel alloy. The copper-tin alloy may preferably contain tin of 14 volume percentage and less.

According to the present invention, above described preferable metals are used as the starting metal to prepare metal powder having finer and more homogenous open pores than that prepared by prior method.

According to the present invention, the starting metal may be solid, and preferably have a powder or granular flake form having particle size of 3~3000 $\mu$m, weight of 0.1~1000 mg, or a wire form having diameter of 3~3000 $\mu$m. Also, the starting metal may have a foil form having thickness of 200 $\mu$m and less.

Such forms of the starting metal may promote the oxidation reaction described hereinafter.

[Oxidation Treatment]

The starting metal is oxidized in the presence of chlorine ($Cl_2$) or chloride to form a block of metal oxide.

Chlorine ($Cl_2$) used in the oxidation treatment may be directly added to the chamber, or solved into water to be added to the chamber.

The chloride useful for the present invention may comprise an element selected from the group of IA~VIIA, VIII and IB~IVB in the elemental periodic table. This chloride is classified to a gas chloride such as hydrogen chloride, and a metal chloride such as copper chloride, tin chloride, cobalt chloride, zinc chloride, iron chloride and nickel chloride. The gas chloride may be directly added to the chamber or solved into water before adding to the chamber for the oxidation treatment. The metal chloride may be directly added to the chamber or solved into a solvent such as water before adding to the reaction chamber.

It is preferable that the metal chloride may be of the same element as that included in the starting metal in order to prevent the obtained porous metal powder from contaminating. For example, in case of preparing copper powder, copper chloride may be preferably added to the chamber. Also, in case of preparing a copper tin alloy, copper chloride or tin chloride may be selected to be added to the chamber.

Chlorine or the chloride may be used individually or in combination with each other.

Chlorine or the gas chloride may be added to the chamber at 0.001~5.0 volume percentage, more especially 0.01~1.0 volume percentage, and the most especially 0.03~0.2 volume percentage.

The metal chloride may be preferably added to the starting metal at 0.01~5.0 mass percentage, more especially 0.1~2.0 mass percentage, and the most especially 0.5~1.5 mass percentage.

The starting metal added into the chamber is mixed with chlorine and/or chloride to be heated for oxidation treatment. The temperature in the oxidation treatment preferably may be 50~1000° C., more especially 200~800° C., and the most especially 300~600° C.

While an exhaust gas occurs in the treatment, it may be noxious to include chlorine, hydrogen chloride and so on, which needs to be neutralized for discharging to the atmosphere.

The oxidized starting metal obtained in the oxidation treatment is followed by the reduction treatment described hereinafter.

Preferably, thereby oxidized starting metal has a block form so that it may be milled for efficiently treating in the following reduction treatment.

[Reduction Treatment]

According to the present invention, the oxidized starting metal obtained in the en above oxidation treatment is reduced into metal with many pores. This reduction treatment is carried out by a well-known method. For example, the reduction treatment may preferably be carried out, not to be limited, in the presence of hydrogen or carbon monoxide. In case of carrying out this treatment in the chamber having an atmosphere including hydrogen or carbon monoxide, the chamber may be heated at 200~800° C. for reduction.

Generally, the metal reduced to be obtained in the above treatment is finely milled by means of using a mill such as a hammer mill and a cutter mill.

The present invention is not intended to limit to a particular theory, but is considered to have a following mechanism, which is different from that of the prior art. Following description is described for preparing copper powder as an example.

Copper as a starting metal is added into a chamber to be mixed with a tiny amount of copper chloride, and the mixture is heated for initiating the oxidation, reaction in which it is considered that a chlorine element causes a transport reaction phenomenon (FIG. 1*a*~FIG. 1*c*).

In the beginning of the transport reaction in the oxidation reaction, the starting copper 1 (shown in the FIG. 1*a*) on the surface is oxidized to change into copper oxide 2 (shown in the FIG. 1*b*). Then, the copper chloride 3 added to the chamber transfers on the produced copper oxide 2 to generate copper oxide 2' and isolate chlorine 4. The isolated chlorine 4 continuously transfers to non-oxidized starting copper 1 to successively produce copper chloride 3' to repeatedly generate copper oxide and isolate chlorine.

This transport reaction phenomenon makes copper oxide in the form of a block of aggregating oxidized particles as shown in FIG. 1*c*. The obtained copper oxide includes copper chloride in a very small amount, having a relatively large surface area.

Figure 2:
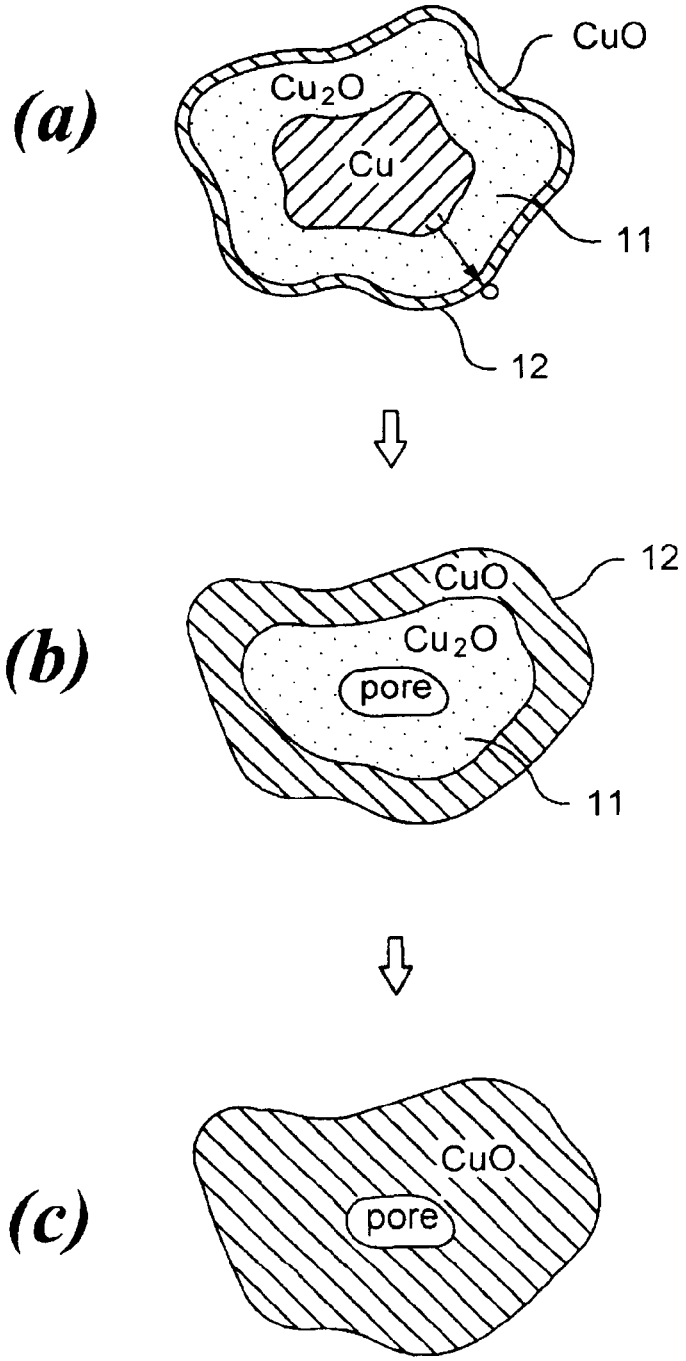
FIG. 2 schematically shows several steps of metal oxide growing in the oxidation reaction according to the prior art.

The present invention is significantly different from the prior art oxidation reaction method in which starting copper is diffused through a surface film of copper oxide shown in FIGS. 2*a*~*c*. The present invention promotes the oxidation reaction faster than that of the prior art.

Figure 3:
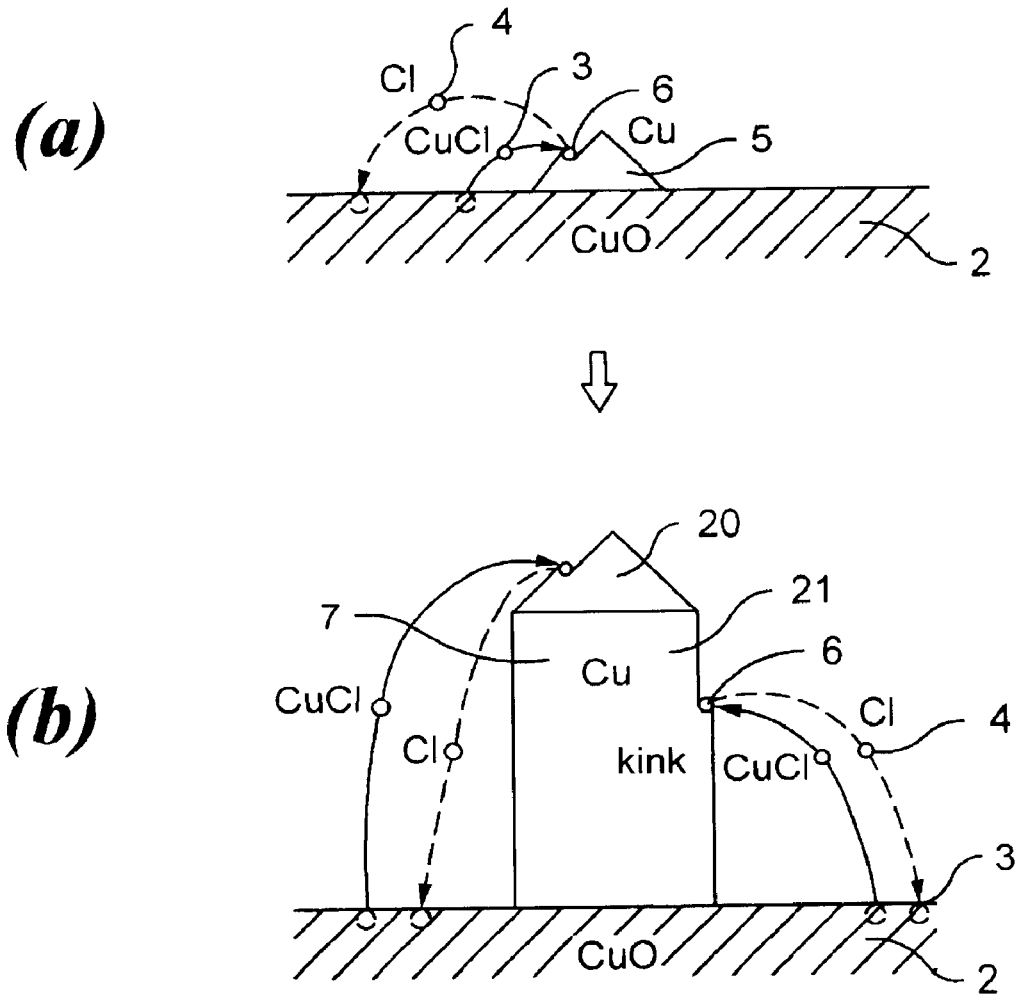
FIG. 3 schematically shows several steps of a prismatic particle growing from the reduced metal according to the present invention.

The above copper oxide is then reduced to change into copper (FIG. 3*a*). The reduction treatment according to the present invention is considered to have another transport reaction phenomenon through chlorine element as follows.

In the beginning of the reduction reaction, one part of the surface of the copper oxide 2 is reduced to change into copper 5 (FIG. 3*a*). Tiny amount of copper chloride 3 included therein transfers on the changed copper 5 (especially on the kink 5). This copper chloride 3 on the copper 5 is reduced to change into copper and isolated chlorine 4. The isolated chlorine 4 then transfers on non-reduced copper oxide 2 to successively change into copper chloride to be reduced to repeatedly change into copper and isolated chlorine as described before.

According to the present invention, the copper oxide is reduced to change into copper as forming a projected particle 7 from the surface of the copper oxide 2 shown in FIG. 3*b*. At the beginning of the reduction reaction, the produced particle of copper is considered to have a prismatic body of an apex part 20 of a quadrangular pyramid and a base part 21 of a hexahedron having a bottom face corresponding to the bottom face of the said quadrangular pyramid.

Above mentioned reduction reaction may occur at any part of the surface of the copper oxide shown in FIG. 1*c*, each particle having a similar shape and size since they are generally determined by the kind of metal and the condition for en oxidation-reduction. The prismatic particles are complicatedly entangled each other like a root to form open pores. According to the present invention, the pore is hardly closed. Thus the metal powder obtained by the present invention has many open pores formed, which is different from the prior art oxidation-reduction method.

The condition for oxidation and reduction according to the present invention maybe varied for preparing porous metal powder with modified properties depending on its application. Several characteristics of the present metal powder are described as follows, which is concerned about metal powder having a particle size of 1 mm and less selected by JISZ-8801.

(1) Present metal powder may preferably have an average particle size of 1000 μm and less, especially 5~300 μm, more especially 10~200 μm, and the most especially 30~100 μm, which is measured by a laser diffraction method.

(2) Present metal powder may comprise a prismatic particle having a diameter of 0.1~5 μm, especially 1~3 μm, which is directly measured by SEM.

(3) Present metal powder may have a pore diameter of 0.2~10 μm, more especially 1~7 μm, and the most especially 3~6 μm, which is measured by a porosimeter.

(4) Present metal powder may have a cumulative volume of open pore of 0.02~0.20 $cm^3/g$, more especially 0.08~0.20 $cm^3/g$, and the most especially 0.10~0.20 $cm^3/g$, which is measured by a porosimeter.

(5) Present metal powder may have a specific surface area of 0.1~2 $m^2/g$, especially 0.3~1 $m^2/g$, which is measured by a BET method.

(6) Present metal, powder may have a relative density ratio of 5~30%, especially 10~25%, which is calculated from an apparent density measured by ISO-3923.

(7) Present metal powder may include chlorine element at a percentage content of 5000 ppm and less, more especially 1~1000 ppm, and the most especially 10~500 ppm. It was generally measured by that a piece of sample is solved into nitric acid followed by that silver ion is dropped thereinto to precipitate the chlorine ion as silver chloride (AgCl) followed by that the amount of the remained silver ion is measured by an induced plasma emission spectral analysis (ICP).

The present metal powder may be useful for various applications. For example, the present metal powder is compressed to form and then heated at 600~800° C.

(especially 700° C.) for several hours (especially 1 hour) to obtain a sintered metal, which may be useful for a catalyst, an electrode, a filter and an oil retaining bearing.

This sintered metal may preferably have following characteristics.

(1) The present sintered metal may have an open pore percentage of 20~80%, more especially 30~80%, which is measured by a porosimeter.

(2) The present sintered metal may have a pore diameter of 1~20 $\mu$m, more especially 2~10 $\mu$m, and the most especially 3~8 $\mu$m, which is measured by a porosimeter.

Embodiment

Several embodiments according to the present invention are described as follows.

EXAMPLE 1

Mixture of 10 kg of the starting copper having a diameter of 0.3 mm and a length of 3 mm and 0.1 kg of $CuCl_2$ was prepared in a chamber. The inside of the chamber was heated at 400° C. for 1 hour to produce a block of metal oxide. This block was milled by a cutter mill to have a diameter of about 100 $\mu$m and then heated at 400° C. for 30 minutes in hydrogen flow for reduction. The obtained copper was milled by a cutter mill to produce copper powder. Various analyses were applied to the obtained copper powder, whose results are shown in Table 1.

EXAMPLE 2

Instead of $CuCl_2$ used in the example 1, an air including hydrogen chloride of 0.07 volume % was flown through the chamber for oxidation reaction. Detail conditions for oxidation and reduction reactions in the example 2 are shown in Table 1. The results of the analyses for the obtained copper powder are also shown in Table 1.

EXAMPLE 3

Instead of $CuCl_2$ used in Example 1, an air including hydrogen chloride of 0.05 volume percentage was flown through the chamber for oxidation. Detail conditions for oxidation and reduction reactions in the example 3 are shown in Table 1. The results of the analyses for the obtained copper powder are also shown in Table 1.

EXAMPLES 4 TO 6

Instead of copper as a starting metal used in the examples 1 to 3, cut wire of Cu-10% Sn alloy was used. Detail conditions for oxidation and reduction in the examples 4 to 6 are shown in Table 1. The results of the analyses regarding the obtained copper tin alloy powder are shown in Table 1.

EXAMPLES 7 TO 8

Instead of copper as a starting metal used in Examples 1 to 2, cut wire of nickel was used. Detail conditions for oxidation and reduction in the examples 7 to 8 are shown in Table 1. The results of the analyses regarding the obtained nickel powder are shown in Table 1.

COMPARED EXAMPLES

Several examples for comparison outside the scope of the present invention are shown as followings.

COMPARED EXAMPLE 1

Copper wire was oxidized without $CuCl_2$ used in Example 1. Detail conditions for oxidation and reduction in this example are shown in Table 1. The results of the analyses regarding the obtained copper powder are shown in Table 1.

COMPARED EXAMPLE 2

Cu-10% Sn alloy wire was oxidized without $CuCl_2$ used in the example 4. Detail conditions for oxidation and reduction in this example are shown in Table 1. The results of the analyses regarding the obtained Cu-10% Sn alloy powder are shown in Table 1.

COMPARED EXAMPLE 3

Nickel wire was oxidized without $CuCl_2$ used in Example 7. Detail conditions for oxidation and reduction in this example are shown in Table 1. The results of the analyses regarding the obtained nickel powder are shown in Table 1.

The obtained results shown in table 1 tell several benefits for the present invention when compared to the corresponding kind of prior art metal powder.

The obtained metal powder according to the present invention has a lower relative density ratio than that of the prior art. This result comes from present metal powder having larger pores than that of the prior art.

Metal powder according to the present invention has a larger open pore diameter than that of the prior art.

Metal powder according to the present invention has a larger cumulative volume of open pore than that of the prior art. This result comes from the present metal powder having larger open pores.

Metal powder according to the present invention has a larger specific surface area than that of the prior art. This result comes from many fine pores formed on the present metal powder.

Figure 4:
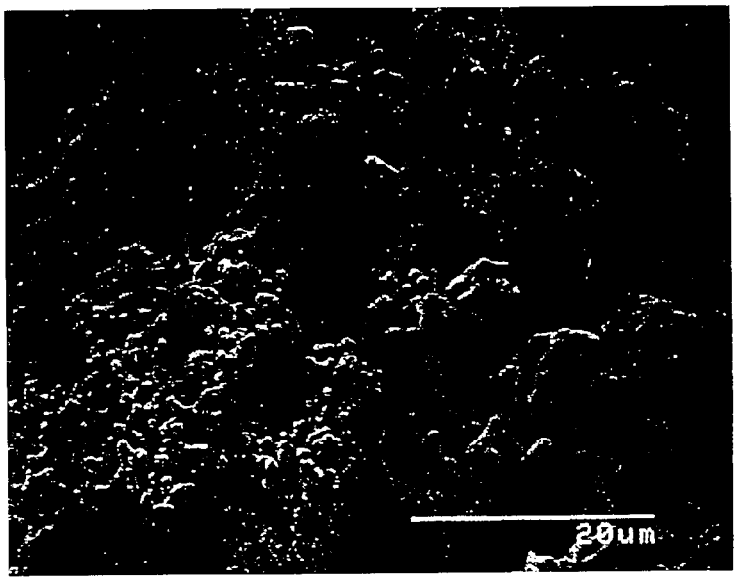
FIG. 4 shows a figure of the porous metal powder magnified by an electron microscope according to the present invention.
Figure 4:
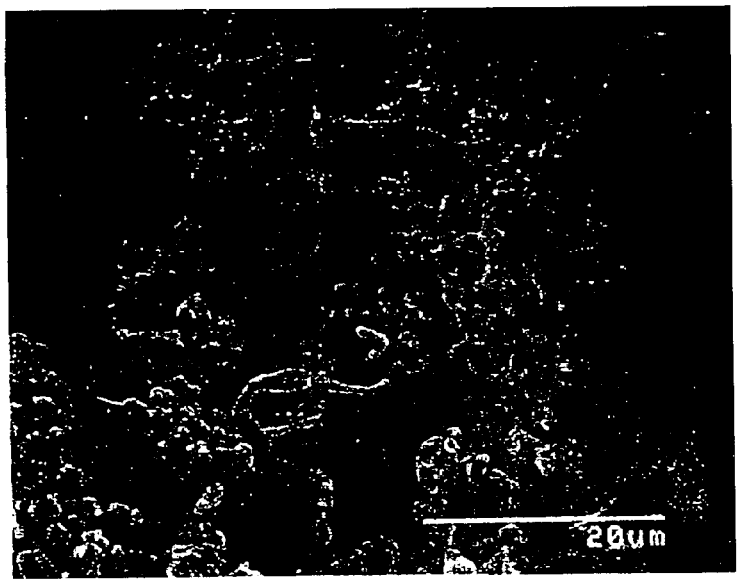
Figure 5:
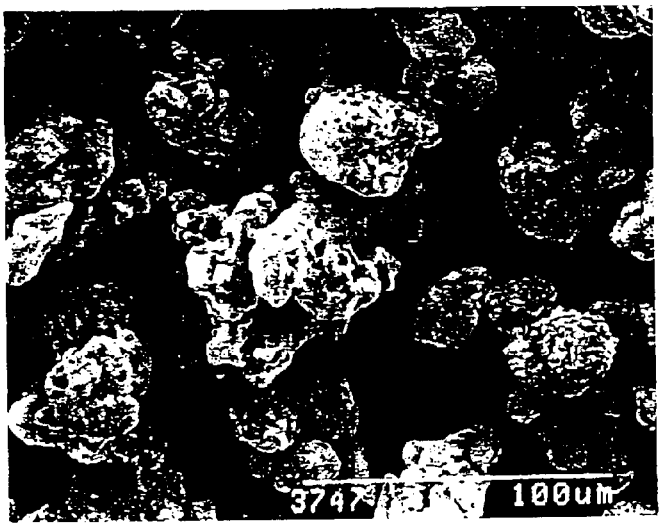
Fig. 5 (Prior Art)
FIG. 5 shows a figure of the porous metal powder magnified by an electron microscope according to the prior art.
Figure 5:
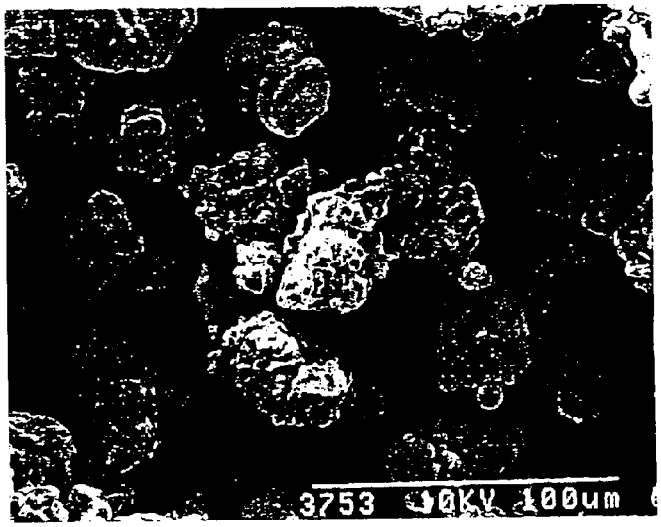
Fig. 5 (Prior Art)

FIG. 4 shows metal powder according to the present invention magnified by an electron microscope, and FIG. 5 shows metal powder according to the prior art magnified by an electron microscope. According to FIGS. 4 and 5, it is understood that the metal powder of the present invention, as shown in FIG. 4, has many columnar or prismatic particles entangled with each other as side roots or root hairs, the columnar or prismatic particles extending in various directions so as to form many pores between the particles (See FIGS. 4(*a*) and (*c*)), while the metal powder according to the prior art, shown in FIG. 5, does not have pores and is independently dispersed.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

| Porous Metal Power | Cu | | | | Cu-10% Sn Alloy | | | | Ni | | |
|---|---|---|---|---|---|---|---|---|---|---|---|
| Example number/Compared example number | exp. 1 | exp. 2 | exp. 3 | comp. 1 | exp. 4 | exp. 5 | exp. 6 | comp. 2 | exp. 7 | exp. 8 | comp. 3 |
| Oxidation | | | | | | | | | | | |
| The amount of starting metal (kg) | 10 | 10 | 10 | 10 | 10 | 10 | 10 | 10 | 10 | 10 | 10 |
| Chlorine or Chloride $CuCl_2$ (kg) | 0.1 | — | 0.1 | — | 0.1 | — | 0.1 | — | 0.1 | — | — |
| HCl (vol %) | — | 0.07 | 0.05 | — | — | 0.07 | 0.05 | — | — | 0.07 | — |
| Temperature for heating (° C.) | 400 | 600 | 300 | 500 | 400 | 600 | 300 | 500 | 400 | 600 | 500 |
| Hours for heating (h) | 1 | 2 | 4 | 10 | 1 | 2 | 4 | 10 | 1 | 2 | 10 |
| Reduction | | | | | | | | | | | |
| Atmosphere | $H_2$ | $H_2$ | $H_2$ | $H_2$ | $H_2$ | $H_2$ | $H_2$ | $H_2$ | $H_2$ | $H_2$ | $H_2$ |
| Temperature for heating (° C.) | 400 | 600 | 400 | 400 | 600 | 600 | 600 | 600 | 600 | 600 | 600 |
| Hours for heating (h) | 0.5 | 0.5 | 0.5 | 0.5 | 0.5 | 0.5 | 0.5 | 0.5 | 0.5 | 0.5 | 0.5 |
| Property | | | | | | | | | | | |
| Relative density ratio (%) | 15 | 24 | 16 | 27 | 18 | 22 | 20 | 26 | 12 | 14 | 25 |
| Average diameter of the metal powder ($\mu$m) | 45 | 65 | 50 | 57 | 50 | 55 | 47 | 50 | 35 | 45 | 20 |
| Open pore diameter ($\mu$m) | 3.1 | 4.5 | 3.5 | 1.5 | 3.9 | 3.5 | 3.7 | 1.8 | 3.3 | 3.5 | 1.1 |
| Cumulative volume of open pore ($cm^3/g$) | 0.18 | 0.12 | 0.16 | 0.008 | 0.14 | 0.12 | 0.16 | 0.01 | 0.19 | 0.15 | 0.01 |
| Specific surface area ($m^2/g$) | 0.56 | 0.35 | 0.46 | 0.16 | 0.36 | 0.31 | 0.42 | 0.14 | 0.44 | 0.41 | 0.13 |
| Chlorine content (ppm) | 180 | 70 | 200 | — | 110 | 90 | 105 | — | 70 | 90 | — |
| Number of the figure by an electron microscope | FIG. 4 (a) | — | — | FIG. 5 (b) | FIG. 4 (c) | — | — | FIG. 5 (d) | — | — | — |

We claim:

1. A porous metal powder having many open pores, wherein the metal powder is obtained by an oxidation-reduction method of a starting metal, and comprises particles having an entangled root-shaped or rhizoid structure, and wherein the porous metal powder has a cumulative volume of open pores of 0.02~0.2 $cm^3/g$, an open pore diameter of 0.2~10 $\mu$m, a specific surface area of 0.1~2 $m^2/g$ as measured by a BET method, a chloride content of 5000 ppm or less; and a relative density ratio of 10~25%.

2. The porous metal powder according to claim 1, wherein the porous metal powder has a specific surface area of 0.3~1 $m^2/g$ as measured by a BET method.

3. The porous metal powder according to claim 1, wherein the porous metal powder has a pore diameter of 3~6 $\mu$m.

4. The porous metal powder according to claim 1, wherein the porous metal powder comprises copper or its alloy.

* * * * *